US007048090B2

(12) United States Patent
Dean et al.

(10) Patent No.: US 7,048,090 B2
(45) Date of Patent: May 23, 2006

(54) SAFETY APPARATUS FOR ARRESTING THE FALL OF A WORKER

(75) Inventors: John Lawrence Dean, Redcliffe (AU); Troy Joseph Birnbrauer, Andrews (AU)

(73) Assignee: MSPH Pty LTD (AU)

( * ) Notice: Subject to any disclaimer, the term of this patent is extended or adjusted under 35 U.S.C. 154(b) by 0 days.

(21) Appl. No.: 10/747,555

(22) Filed: Dec. 29, 2003

(65) Prior Publication Data

US 2004/0140153 A1 Jul. 22, 2004

Related U.S. Application Data

(63) Continuation-in-part of application No. 10/069,739, filed as application No. PCT/AU99/00986 on Nov. 9, 1999, now Pat. No. 6,691,826.

(51) Int. Cl.
*A47L 3/04* (2006.01)
*E04G 3/14* (2006.01)
*E04C 3/30* (2006.01)

(52) U.S. Cl. ..... 182/3; 182/36; 52/736.1; 256/DIG. 6

(58) Field of Classification Search ..... 182/3–5, 182/45, 112, 113, 36; 248/125.2; 256/59, 256/53, 65, 67, DIG. 6, DIG. 65; 52/127.2, 52/731.4, 732.3, 736.1
See application file for complete search history.

(56) References Cited

U.S. PATENT DOCUMENTS 4,037,824 A * 7/1977 Whitmer ..... 256/53
4,480,819 A 11/1984 Lopez
5,029,670 A 7/1991 Whitmer
5,307,897 A * 5/1994 Turner et al. ..... 182/3
6,036,146 A * 3/2000 Paterson ..... 248/125.2
6,053,281 A 4/2000 Murray
6,173,809 B1 * 1/2001 Cole et al. ..... 182/3
2002/0100636 A1 8/2002 Cole
2003/0159883 A1 8/2003 Carson

* cited by examiner

*Primary Examiner*—Hugh B. Thompson, II
(74) *Attorney, Agent, or Firm*—Jason A. Bernstein; Powell Goldstein LLP

(57) ABSTRACT

A safety apparatus for use by a worker on an elevated structure is disclosed. The purpose of the apparatus is to arrest the fall of the worker should they fall. Broadly the apparatus comprises at least two support posts having an upper end and a lower end supported on the structure and spaced apart from each other on the structure. Each support post has an I-shaped cross sectional configuration. The apparatus also includes a clamp on the lower end of each support post for clamping the post to the structure. The clamp itself comprises a base plate fast with the support post, a secondary plate or clamping plate spaced beneath the base plate, and fastening elements for drawing the two plates, towards each other with a member of the structure firmly clamped there between. The base plate projects laterally outwardly from the post on two opposed sides of the post, and defines at least one slot aperture on each said opposed side of the post through which the fastening elements are passed. Each post also has connecting formations towards the upper end thereof and an overhead safety line extending between said posts at a height of 1.7 to 2.0 metres above the member on which the posts are mounted. Each worker who works on the structure is fitted with a harness and a safety lead that can be releasably clipped to the safety line. This arrests the workers should they fall.

35 Claims, 19 Drawing Sheets

SAFETY APPARATUS FOR ARRESTING THE FALL OF A WORKER

CROSS-REFERENCE TO RELATED APPLICATION

This application is a continuation-in-part of application Ser. No. 10/069,739 filed Feb. 25, 2002 now U.S. Pat. No. 6,691,826, which is a 371 of PCT/AU99/00986 filed Nov. 9, 1999, the disclosure of which is incorporated by reference in its entirety herein.

FIELD OF THE INVENTION

This invention relates to a safety apparatus for use by workers working in elevated positions on structures above the ground. The purpose of the apparatus generally is to arrest the fall of the worker should they somehow slip off or fall from the elevated position to avert death or injury to such person.

This invention relates particularly but not exclusively to safety apparatus for use during the construction of a building and it will therefore be convenient to hereinafter describe the invention with reference to this example application. However it is to be clearly understood that the invention is capable of broader application. For example it could also be used by workers performing maintenance type activities on existing buildings. It could also be used on structures other than buildings, such as bridges, walls, towers and the like.

BACKGROUND TO THE INVENTION

Very often during the construction of a building, it is necessary for a worker to perform work at an elevated position above the ground, e.g. greater than three meters above the ground. One example of such an activity is where a worker is required to work on a roof structure. This will involve lifting I-beams which form the roof rafters up onto the roof and then mounting them on the basic frame of the building. Thereafter roof purlins extending the length of the roof are mounted on the rafters transverse thereto and sheeting is then applied to the purlins.

As can be seen this process requires workers to perform difficult and precise operations while they are perched high up on a beam or other structural member. It is quite possible that they could slip and fall and the consequences of this could be disastrous. Accordingly it is highly desirable that workers be provided with safety apparatus to help them to avoid suffering serious injury or death should they fall. This has been recognized by the authorities around the world who require safety apparatus to be provided for such workers. There is now an Australian standard in place for these types of safety apparatus that is Australian Standard No. 1891.2.2000.

Various forms of safety apparatuses have been proposed to improve the safety of workers working on elevated structures.

One such example is in the form of a temporary rail or barrier around the periphery of a structure having a roof. This works by acting as a physical barrier to stop a worker from falling over the edge of the building if they slip. However the limitation of this apparatus is obvious. It does not physically tether a worker to the structure and does not arrest their fall if they fall off a building. It is limited to horizontal or sloping roof structures where the roof sheeting or roof tiles are already in place. It has little or no benefit in an open frame structure where a worker can fall through the internal space defined by the building.

Safety apparatuses are also known where a worker is connected to or tethered to a safety line. However, many of these apparatuses do not offer a worker sufficient freedom to move around and do their work efficaciously. Further there are considerable difficulties in achieving the necessary mechanical strength to arrest the fall of an adult male worker. Part of the problem is that the safety apparatus is usually a temporary structure which is mounted on a roof, e.g. by being attached to a beam, and which has to be light enough to be lifted onto the roof. Further it also needs to provide a worker with satisfactory mobility over a roof area and also not inhibit their working activities.

In Applicant's experience very often apparatus of this general type is not strong enough to arrest the fall of a stout adult male weighing 70–100 kg.

Thus there are a large number of criteria to meet when designing such a system and a satisfactory solution to the problem has been elusive. Accordingly it would clearly be advantageous if an apparatus could be devised that overcame the problem.

SUMMARY OF THE INVENTION

According to one aspect of this invention there is provided a safety apparatus for use by a worker on an elevated structure for arresting the fall of the worker should they fall, the apparatus comprising:

- at least two support posts having an upper end and a lower end supported on the structure, and the posts being spaced apart from each other on the structure, each support post having a central web and transverse flanges projecting outwardly from each side of the web at each end of the web;
- a clamp on the lower end of each support post for clamping the post to the structure;
- connecting formations towards the upper end of each post for connecting a safety line thereto or passing a safety line therethrough;
- an overhead safety line extending between said posts; and
- a harness and lead for each worker which can be operatively connected to the safety line.

Each support post may have a cross-sectional configuration in the form of an I, e.g. much like an I-beam.

Each support post may be oriented relative to the safety line with the web extending substantially parallel to the safety line and the flange extending transversely to the safety line. This will usually provide greater strength should a worker tethered to the safety line fall and place a high load on an upper region of the post.

Each clamp may comprise a base plate fast with the support post, a secondary plate or clamping plate spaced beneath the base plate, and fastening elements for drawing the two plates towards each other in use with a member of the structure firmly clamped there between.

The base plate may project laterally outwardly from the post on at least two opposed sides thereof, and the base plate may define at least one slot aperture on each said opposed side. Preferably the base plate defines two diagonally extending slot apertures on each said opposed side.

Each fastening element may comprise a screw threaded bolt for passing through a said slot aperture in the base plate and a bolt aperture in the clamping plate. A nut is passed over the bolt and fastened to clamp the base plate, structure member and clamping plate together.

Optionally each clamp may further include a spacing formation sandwiched between the base plate and the clamping plate, positioned relative to the bolts for exerting a pivotal clamping action on the clamping plate, and enhancing the clamping of the clamping plate to the structure member.

The clamping plate or secondary plate may be substantially vertically aligned with the base plate but spaced beneath the base plate with the member sandwiched there between. Further a fastening element may extend through the base plate and secondary plate laterally outwardly of the structure member on each side of the member to encase the member within the base plate, secondary plate and fastening elements. Advantageously two said fastening elements are passed through the base plate and secondary plate laterally outwardly of each side of the structure member.

The structure member to which the support post is clamped may be one of an I-beam, H-beam, channel beam, RHS-beam or UB-beam.

One or more of the connecting formations may comprise an aperture defined in the web of the support post and/or an aperture defined in each of the flanges of the support post. Further the one or more connecting formations may comprise an anchor bracket mounted on the support post, e.g. a U-bolt. The U-bolt is mounted in a bilaterally symmetrical position on the flange so as to centralise the forces applied through the safety line to the post, and more particularly along a line coincident with the web of the post, and thereby load the post in an advantageous way.

The U-bolt may be mounted on the post by being passed through apertures defined in a said flange of the post. Advantageously the anchor brackets may be mounted on the posts via the apertures described above, e.g. by being passed through the apertures. Optionally a screw thread on the ends of the U-bolt may engage a complementary screw threaded bolt defined in the apertures. Alternatively the U-bolt may be passed through the apertures and attached to a retaining nut on the other side of the aperture.

Each post may further include at least one cut-out defined in the web of each post intermediate the upper and lower ends thereof.

Preferably each post defines a plurality of said cut-outs and the cut-outs are located at spaced intervals along the length of the post. Each post may further include a handle formation for assisting a worker to lift and carry the support post.

The support posts may be made of aluminium to keep the weight of the post down within manageable limits and may be made in an extrusion process.

The apparatus may further include a tensioner for tensioning the safety line extending between the support posts, e.g. a turnbuckle.

The lead may include a slide coupling for permitting the lead to slide freely along the length of the safety line that can be opened on demand to connect and disconnect the worker from the safety line. Advantageously the coupling may be in the form of a quick release shackle.

The safety line may be at a height of 1.5–2.5 m above the member on which the posts are mounted, preferably at a said height of 1.7 to 2.0 m. Even more preferably the safety line is 1.8 m–1.9 m above said member and the support posts are a similar height.

In one form each support post is approximately 1.8 m high and in another form each support post is approximately 1.9 m high.

According to another aspect of the invention, there is provided a safety apparatus for enhancing worker safety, the apparatus including, a support arrangement that is locatable proximate a hazardous working area; and a connecting arrangement that defines at least one pair of opposed connecting points, the connecting points of the, or each, pair being positioned on opposed sides of the hazardous area so that a line connecting the points spans the hazardous area.

The support arrangement may be mountable on a structure that defines the hazardous working area.

The support arrangement may include at least two support posts that are mounted on an overhead structure to extend upwardly from the overhead structure. In particular, a number of support posts may be mounted on the overhead structure such that a network of safety lines can be positioned above the overhead structure.

Each support post may include a rod that has a base fixed to a lower end thereof. The base may include a base plate and stabilising web members. The base plate and the web members may be fixed to the lower end of the rod.

The safety apparatus may include a number of fastening arrangements to permit each support post to be fastened to a beam of the overhead structure. Each fastening arrangement may be in the form of a clamping device to permit each base to be clamped to the beam.

The connecting arrangement may include a connecting formation positioned on an upper end of each rod. Each connecting formation may be configured to permit at least one line to be attached to each connecting formation.

Each connecting formation may be in the form of a number of projections extending laterally from the upper end of each rod. Each projection may have an opening defined therein to permit an end of a line to be connected to each projection.

Each support post may be of sufficient length to facilitate movement of workers beneath safety lines connected between the support posts.

According to yet another aspect of the invention there is provided an anchor member for a safety apparatus for enhancing worker safety, the anchor member including:

an elongate support post that has a lower end that is fastenable to a structure so that the support post extends upwardly from the structure in use; and a connecting arrangement positioned at an upper end of the support post to permit an end of a safety line to be connected to the support post.

A base may be fixed to the lower end of the support post, the base being fastenable to the structure. The base may include a base plate that is fixed to the lower end of the support post.

The anchor member may be substantially the same as that of the anchor member of the preceding aspect of the invention described above.

According to yet another aspect of the invention there is provided a kit for a safety apparatus for enhancing worker safety, the kit including:

at least two support posts that are mountable on a structure that defines a hazardous working area to extend upwardly from the support structure; and a connecting arrangement that is positioned on each support post to permit an end of the safety line to be connected to each support post so that the safety line spans the hazardous area.

The support posts and the connecting arrangements of the kit may be those described in the second aspect of the invention described above.

According to yet another aspect of the invention, there is provided a structural assembly which includes:

a structure having an overhead portion that defines a hazardous working area;

a support arrangement that is mounted on the overhead portion of the structure at least proximate the hazardous working area; and a connecting arrangement that defines at least one part of opposed connecting points, the connecting points of the, or each, pair being positioned on opposed sides of the hazardous area so that a line connecting the points spans the hazardous area.

According to yet another aspect of the invention, there is provided a method of enhancing worker safety, the method including the steps of:

mounting a support arrangement having a connecting arrangement that defines at least one pair of opposed connecting points, so that a connecting point is positioned on each side of a hazardous area defined by the support arrangement.

The method may include connecting an end of a safety line to each respective connecting point so that at least one safety line spans the hazardous area.

The method may further include mounting a number of support posts on the overhead portion of the structure, each support post defining at least one connecting point.

Each support post may be detachably mounted to the overhead portion of the structure. Thus, each support post may be removed from the structure after use.

Instead, the support posts may be permanently mounted on the overhead portion of the structure. Thus, the support posts can form an integral part of a finished structure.

BRIEF DESCRIPTION OF THE DRAWINGS

A safety apparatus in accordance with this invention may manifest itself in a variety of forms. It will be convenient hereinafter to describe in detail at least two preferred embodiments of the invention with reference to the accompanying drawings. The purpose of this specific description is to instruct persons having an interest in the subject matter of the invention how to carry the invention into practical effect. It is to be clearly understood however that the specific nature of this description does not supersede the generality of the preceding broad description. In the drawings.

DETAILED DESCRIPTION OF THE PREFERRED EMBODIMENTS

Figure 1:
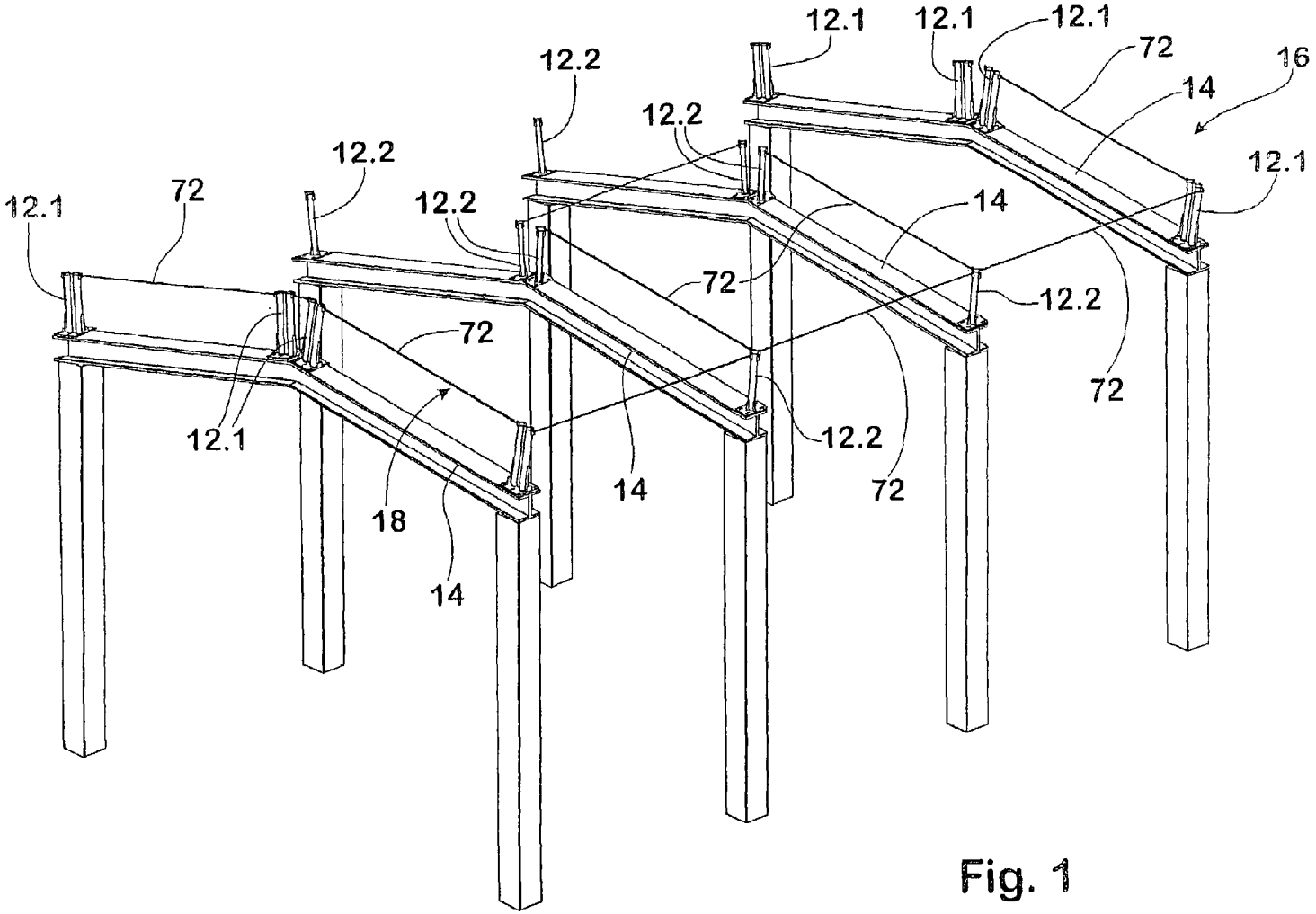
FIG. 1 shows a three dimensional view of a safety apparatus in accordance with one embodiment of the invention.
Figure 2:
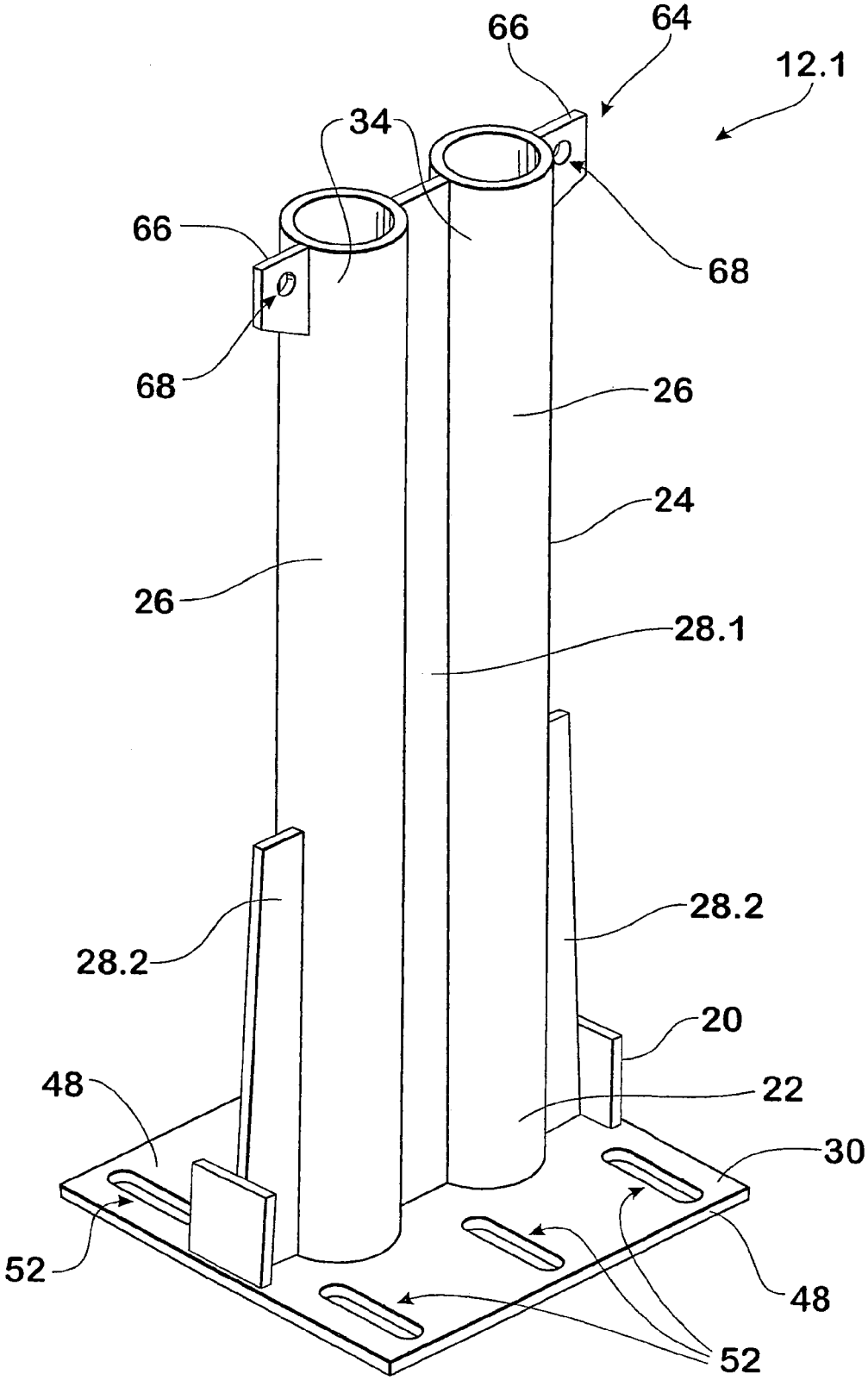
FIG. 2 shows a three dimensional view of a primary anchor member of the safety apparatus of FIG. 1.
Figure 3:
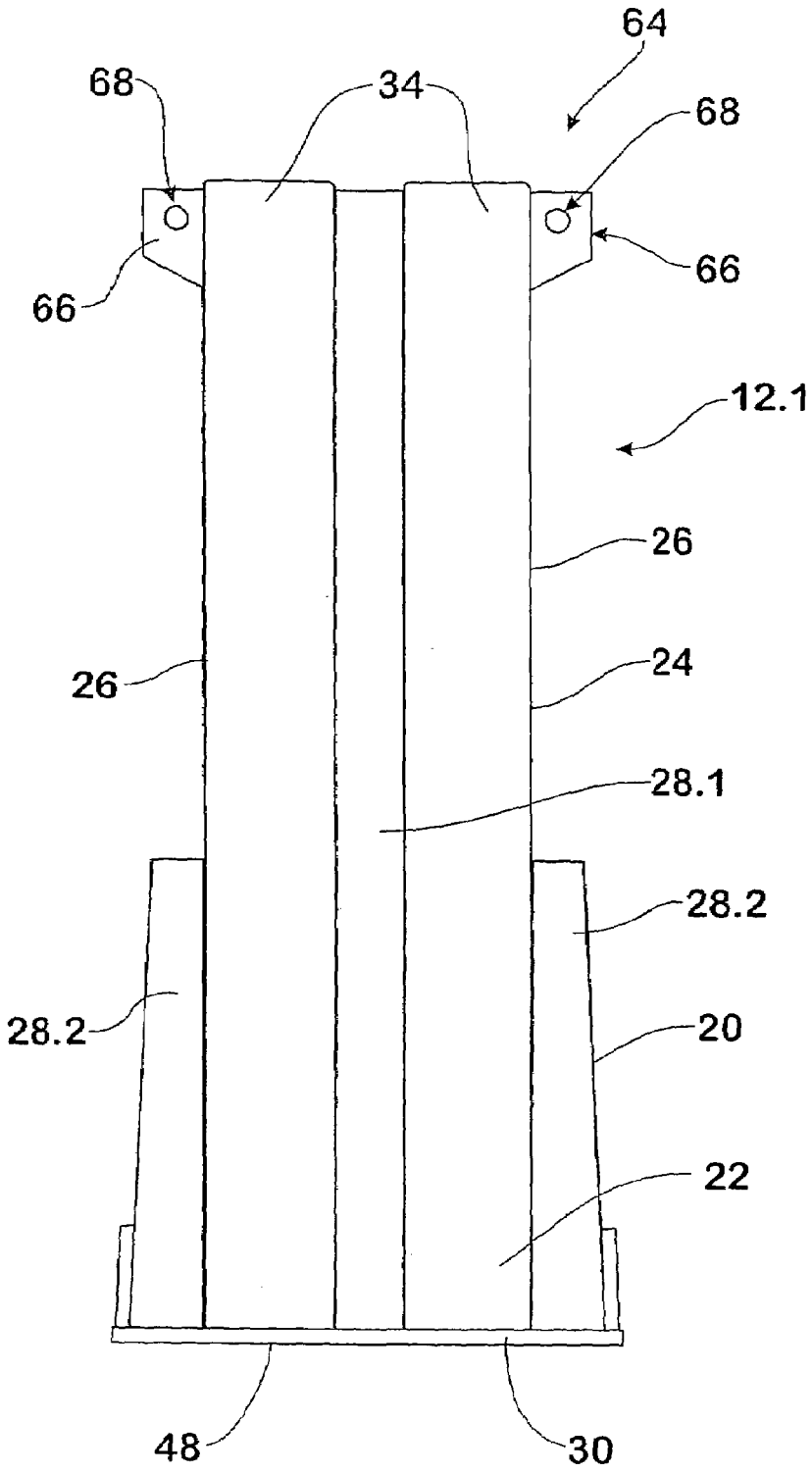
FIG. 3 shows a side view of the primary anchor member of FIG. 2.
Figure 4:
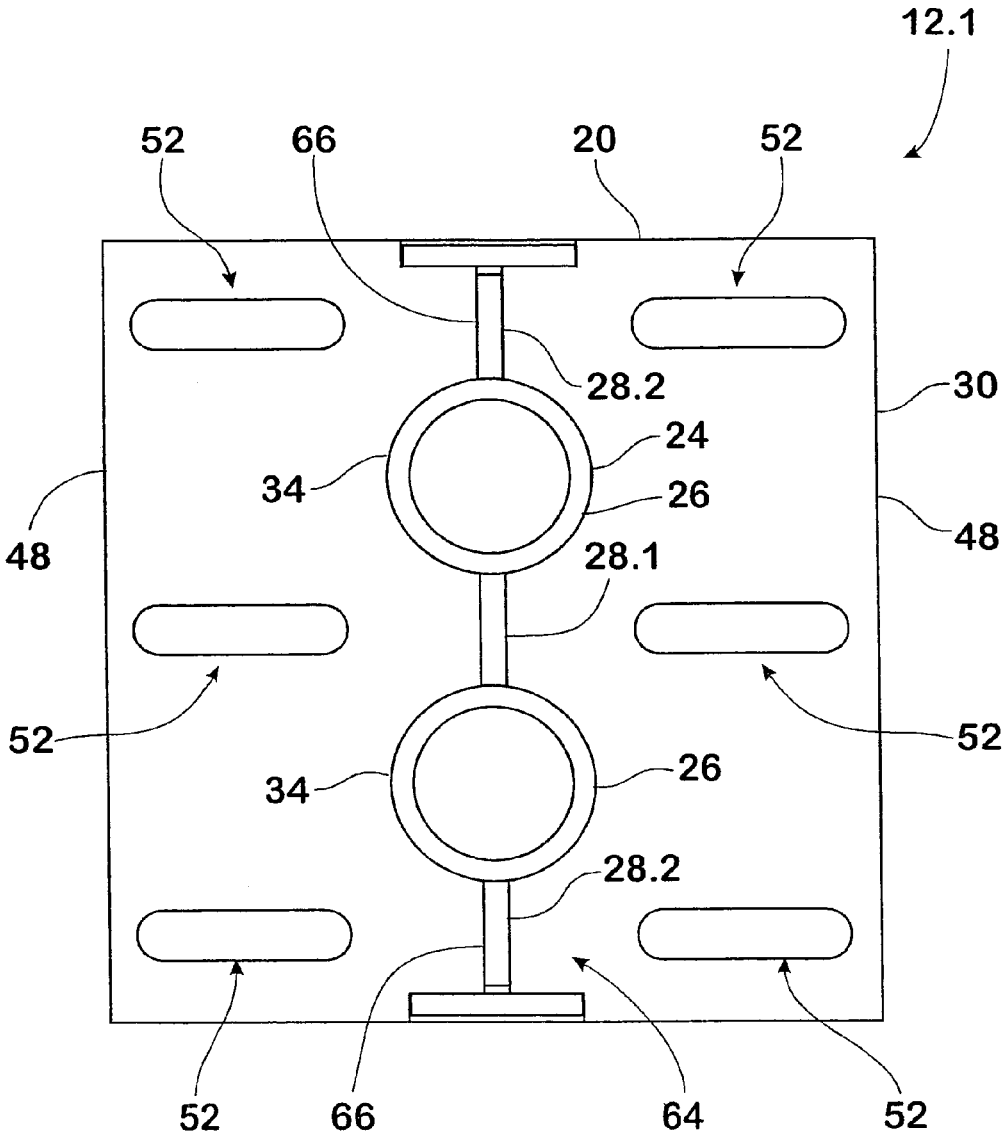
FIG. 4 shows a top plan view of the primary anchor member of FIG. 2.

In FIG. 1, reference 10 generally indicates a safety apparatus in accordance with the invention for enhancing worker safety.

The safety apparatus 10 includes a support arrangement in the form of a plurality of anchor members 12.

The anchor members 12 are fastened to beams 14 of a structure 16.

The beams 14 of the structure 16 define a hazardous working area 18. The anchor members 12 therefore extend upwardly from the beams 12 into the hazardous working area 18.

Each anchor member 12 includes a base 20 fixed to a lower end 22 of a support post 24. The anchor members 12 are divided into a group of primary anchor members 12.1 and a group of intermediate anchor members 12.2.

The support post 24 of each primary anchor member 12.1 includes a pair of elongate tubular members or tubes 26. The tubes 26 are positioned side-by-side. Each tube 26 is circular cylindrical.

The support post 24 of the primary anchor member 12.1 includes three web members 28. The web members 28 comprise an intermediate web member 28.1 that is positioned between the tubes 26 and extends along the length of the tubes 26.

An outer web member 28.2 is connected to each respective tube 26. The web members 28 are fixed to the tubes 26 and to a base plate 30 of the base 20. The beams 14 of the structure 16 are in the form of I-beams.

The base plate 30 of each primary anchor member 12.1 is clamped to a flange 36 of an I-beam 14.

Thus, the safety apparatus 10 includes a number of clamping arrangements 38. Each clamping arrangement 38 includes a clamping plate 40 and a cylindrical spacer 42 mounted on the clamping plate 40. The cylindrical spacer 42 is in the form of a cylindrical rod 44 fixed to the clamping plate 40.

Each clamping plate 40 has a pair of aligned openings 44 defined therein. Each clamping plate 40 has a clamping region 46 positioned on one side of the openings 44 with the cylindrical rod 42 positioned on an opposed side of the openings 44 in spaced, parallel relationship to the openings 44.

In use, the base plate 30 is positioned on a respective flange 36. The base plates 30 are dimensioned so that sides 48 extend beyond edges 50 of the flange 36. The base plate 30 has a number of slotted openings 52 defined therein. The slotted openings 52 are positioned on each side of the tubes 34, with each opening extending away from the tubes 34 towards the edges 50 of the flange 36.

The slotted openings 52 are configured so that, when the base plate 30 is positioned on the flange 36, the slotted openings 52 are accessible from beneath the flange 36. Thus, the clamping plate 40 is designed so that when the clamping region 46 bears against a lower side 54 of the flange 36, the openings 44 are aligned with respective slots 52. Further, the cylindrical spacer 42 is dimensioned and positioned to bear against the base plate 30. A bolt 56 of the bolt and nut combination 58 is received through each opening 44 and each slotted opening 52. A nut 60 and washer 62 are screwed onto each bolt 56 so that the flange 50 is clamped between the base plate 30 and the clamping plate 40. It will be appreciated that the cylindrical spacer 42 provides pivotal clamping action to enhance the clamping effect. Further, the fact that the openings 52 are slotted permits adjustment of the position of each anchor member 12.1 relative to its respective beam 14.

It will readily be appreciated that, where a permanent fastening arrangement is desired, complementary openings can be provided between the clamp plates 40, the flange 36 and the base plate 30 so that a bolt can be received therethrough. However, in this case, the clamping arrangements 38 provide the facility whereby the anchor members 12 can be removed without affecting the integrity of the beams 14.

The clamping plate 40 is shown in this particular example as having two openings 44. This particular clamping plate 40 is intended to be used with the intermediate anchor member 12.2 described below. However, it will readily be appreciated that the clamping plate 40 will have three openings 44 to correspond with the three slotted openings 52 positioned on each side of the tubes 26.

The safety apparatus 10 includes a connecting arrangement in the form of connecting formations 64 positioned on the upper ends 34 of the tubes 26. Each connecting formation 64 is in the form of a lug 66 which extends radially from each tube 26. Each lug 66 has an opening 68 defined therein. An end 70 of a safety line 72 is fastenable to each lug 66 via the opening 68. This fastening can take any desired form such as a suitable clip.

Figure 5:
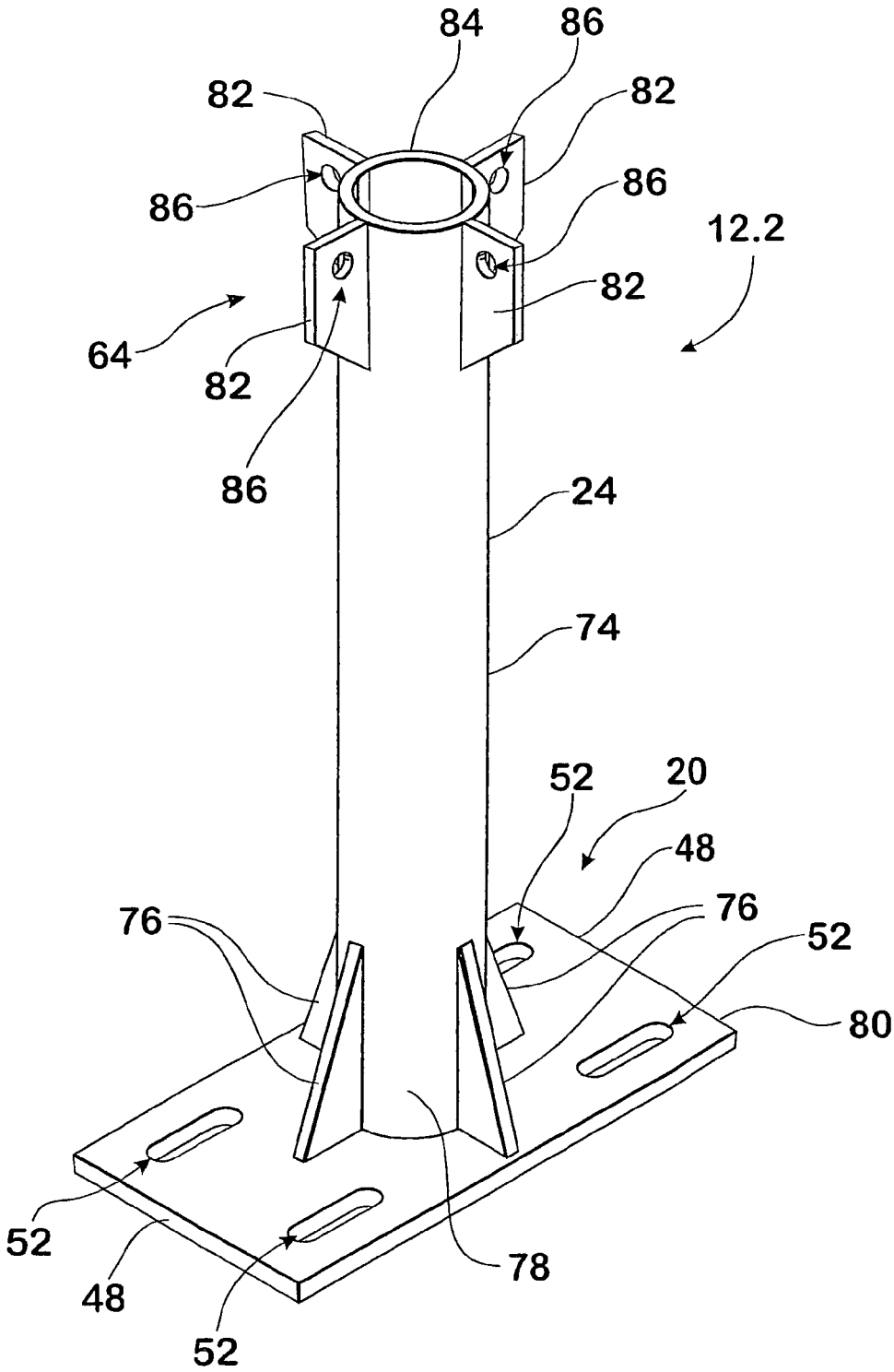
FIG. 5 shows a three dimensional view of an intermediate anchor member of the apparatus of FIG. 1.
Figure 6:
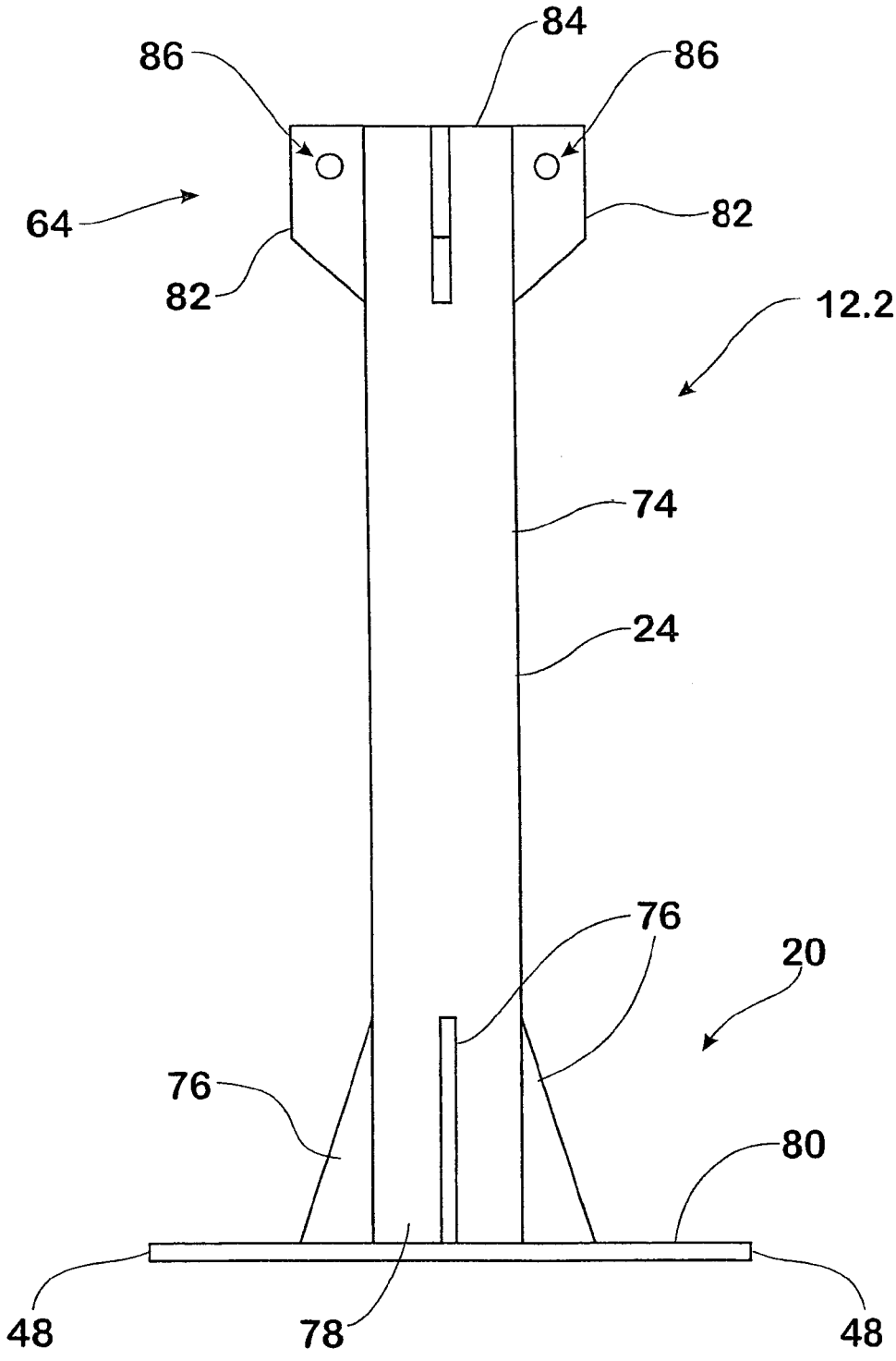
FIG. 6 shows a side view of the intermediate anchor member of FIG. 5.
Figure 7:
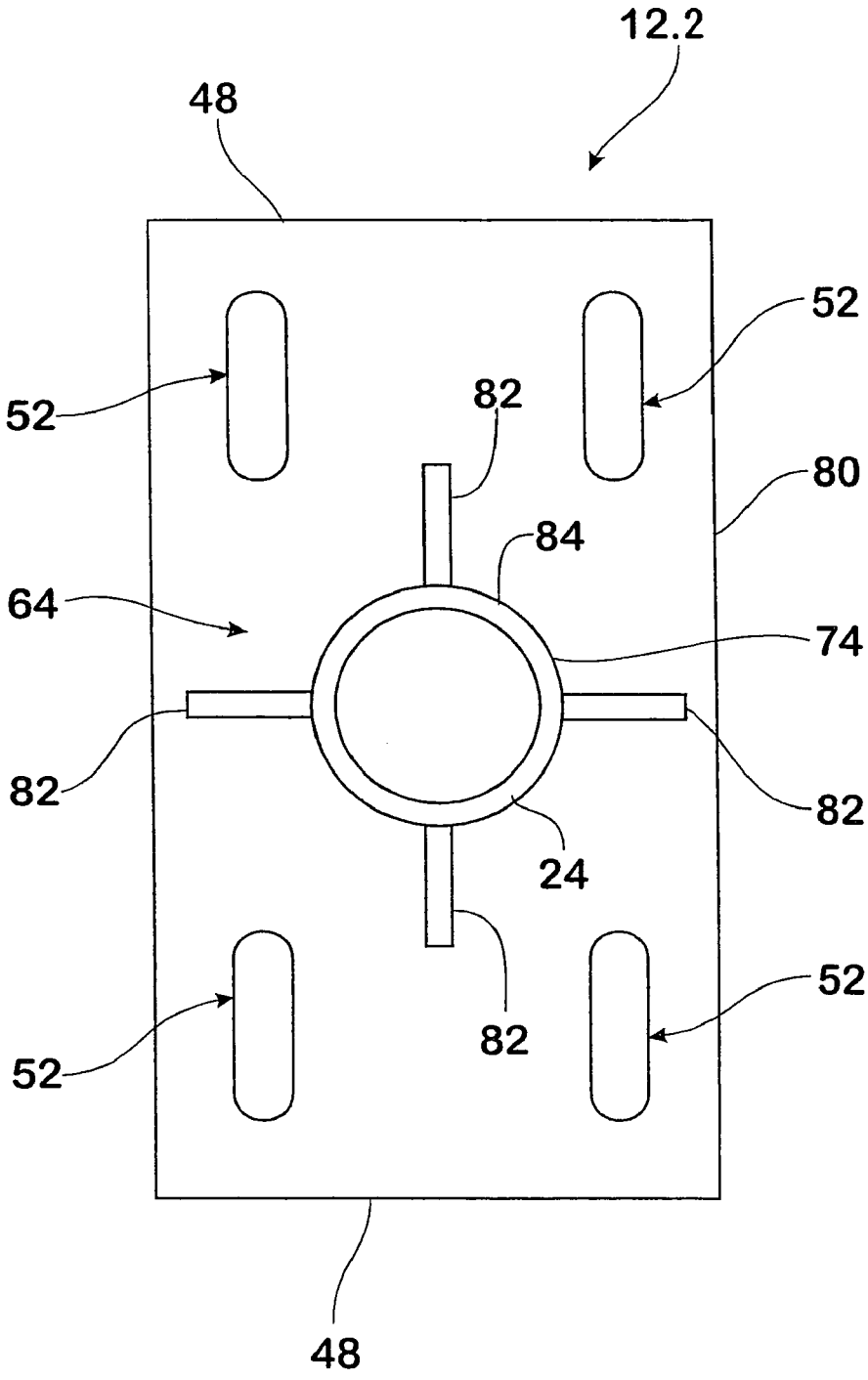
FIG. 7 shows a top plan view of the intermediate anchor member of FIG. 5.
Figure 8:
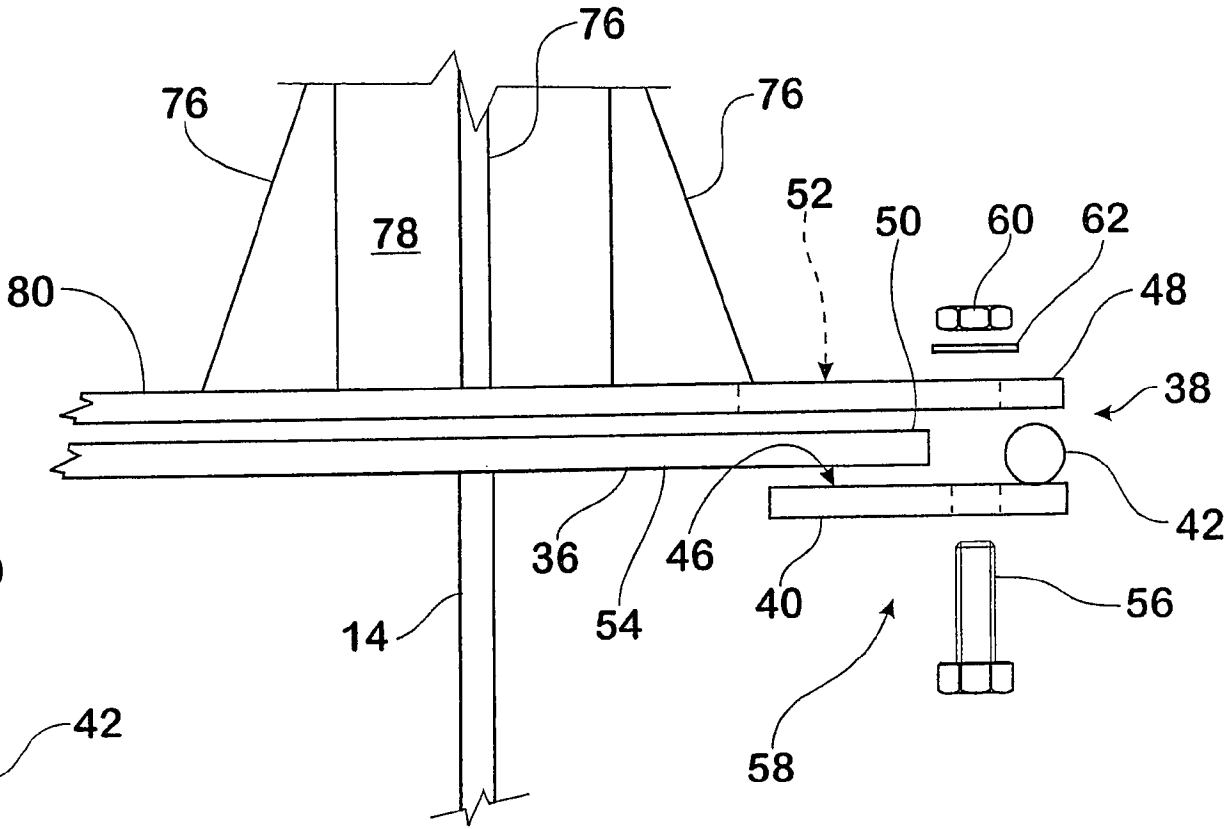
FIG. 8 shows a side view of a post of the safety apparatus of FIG. 1, clamped to a structure member that is an I-beam.
Figure 9:
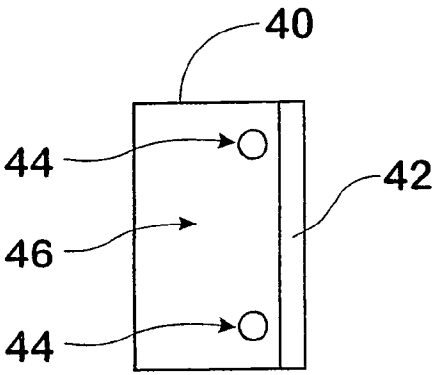
FIG. 9 shows a top plan view of a clamping plate for the apparatus shown in FIGS. 1 and 8.

In FIG. 5, there is shown an intermediate anchor member 12.2. The support post 24 of the anchor member 12.2 includes a single tube 74. Four equally spaced and radially extending web members 76 are fixed to a lower end 78 of the tube 74. The lower end 78 and the web members 76 are fixed to a base plate 80. The base plate 80 also has the slotted openings 52. Thus, the base plate 80 is clamped to the beams 14 in a similar manner as is the base plate 30. Four equally spaced radially extending lugs 82 are fixed to an upper end 84 of the tube 74. Each lug 82 has an opening 86 defined therein. As before, an end 70 of a safety line 72 can be connected to either of the lugs 82 via its respective opening 86.

In use, a plurality of the anchor members 12 are clamped to the beams 14 of the structure 16. A particular arrangement is shown in FIG. 1. Safety lines 72 are connected between various anchor members to define a network of safety lines 72.

A worker positioned in the hazardous working area 18 wears a safety harness with a safety lead extending therefrom. The safety lead can have a running clip fixed thereto, as is common in the field. The running clip can be clipped to any of the safety lines 72 to move along the safety lines as the worker moves within the hazardous working area 18.

Each anchor member 12 is approximately 1.8 metres high. This serves to keep the safety lead out of the way of the worker and therefore prevents entanglements and dangerous situations from arising.

It will readily be appreciated that the primary anchor member 12.1 is of greater strength than the intermediate anchor members 12.2. It follows that the primary anchor members 12.1 are fastened to the beams 14 in positions where the greater amount of force would be generated should a worker slip and be suspended from one of the safety lines 72.

The applicant believes that the safety apparatus 10 provides a means whereby worker safety in a hazardous area is greatly enhanced. The fact that the safety leads are connected displaceably to a point at head height or above, permits a worker to move about freely in the hazardous area without unnecessary entanglements and inconvenience. Still further, the position of the safety lines 72 is such that should a walker slip, the amount of shock generated by the resultant tautening of the safety lead is reduced. This will be appreciated when one considers what the consequence would be should the safety lead be connected to a point at a worker's feet. A further convenient aspect of this invention is that the safety apparatus 10 can be installed either temporarily or permanently. Where the safety apparatus 10 is installed permanently, the safety apparatus 10 forms part of the structure.

FIGS. 10 to 13 illustrate a support post for a safety apparatus in accordance with a second embodiment of the invention. As the post has some similarities to the post described above with reference to FIGS. 1 to 9, the description hereunder is to be read together with that description.

Broadly the post 100 has an upper end 101, and a lower end 102. The post 100 has an I-shaped cross-sectional configuration with a web 103 and two end flanges 104 and 105. A transverse base plate 106 is welded to the lower end 102 of the post 100. The post 100 has a plurality of connecting formations in the form of apertures towards this upper end 101. One said aperture 108 is defined in the web 3. Further apertures are defined in each flange 109 and 110 on either side of the web 103.

Further the post 100 has four circular cut-outs 112 defined in the post 100 spaced apart along the length thereof. The purpose of the apertures 112 is to reduce the weight of the post 100 bearing in mind that it has to be lifted up from the ground into an elevated position on a structure. The post 100 also includes a handle formation 115 to facilitate it being carried and/or lifted by a worker. In the illustrated embodiment, the handle 115 projects outwardly from an outer surface of one of the flanges 104 or 105.

The post 100 is made from aluminium by an aluminium extrusion process. This process is a relatively simple manufacturing process because the basic post, excluding the base plate, is formed in a one step extrusion process rather than a complicated fabrication process involving multiple tubes and welding connections between the tubes. The post 100 with the configuration shown in the drawings has a remarkable strength, yet relatively low weight.

The post 100 also includes a clamp indicated generally by the numeral 118 for clamping it to a structure member, say a beam of the structure on which it is mounted. The clamp comprises the base plate 106 described above, a secondary plate or clamping plate 120 spaced beneath the base plate 106, and fastening elements 125 for clamping the base plate 106 and secondary plate 120 together with the structural member sandwiched therebetween. Typically the fastening elements 125 are in the form of screw threaded bolts with rotatable nuts engaging the screw thread of the bolt.

As illustrated in the earlier drawings above, the base plate 106 may have slots 130 defined therein through which the fastening elements 125 pass. Similarly, the secondary plate 120 may have apertures or slots 132 defined therein through which the fastening elements 125 are passed.

Clearly it is advantageous if not necessary for the support post 100 to be able to be mounted on structural members of different configurations. This enables the utilisation of the apparatus on a wide range of buildings or structures and enhances its adaptability. Typical member configurations are I-beam, H-beam, channel beam, RHS-beam, UB-beam and concrete structures such as concrete tilt panels.

The clamp 118 of the safety apparatus can be adapted to mount the posts 100 to each of these members. The attachment of the post to an I-beam has been described above with reference to FIG. 8. The clamping of the post 100 to the other structural members will now be described below with reference to FIGS. 13 to 17.

Figure 13:
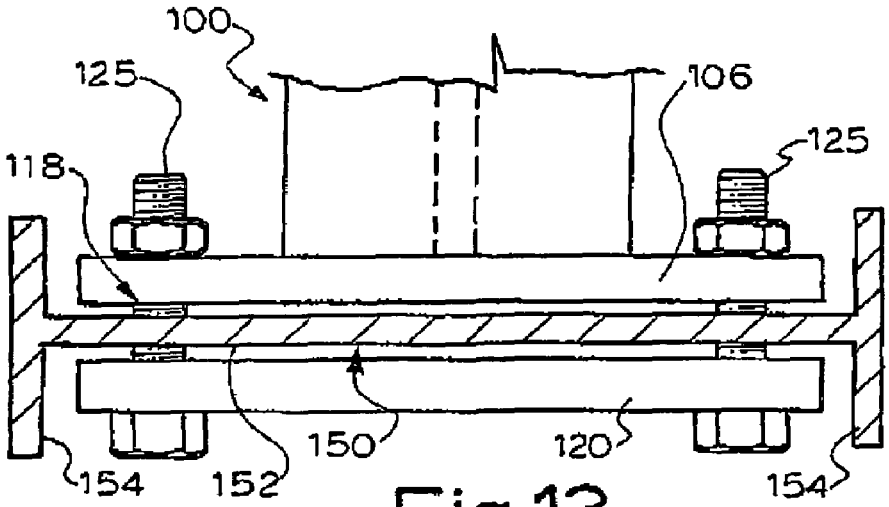
FIG. 13 is an end view of the support post of FIG. 10 mounted on a structure member that is a H-beam.

FIG. 13 shows a post 100 clamped to an H-beam 150. The H-beam 150 has a relatively long horizontal extending web 152 with relatively short vertically extending flanges 154 at each end of the web. The clamp 118 comprises broadly the base plate 106 and a secondary plate 120 underneath the base plate 106. The secondary plate 120 has a similar shape to the base plate 106 and is placed directly underneath the base plate 106. Fastening bolts 125 are then passed through the base plate 106, web 152 of the H-beam 150, and the secondary plate 120. There are fastening bolts 125 on each side of the support post. However holes do need to be drilled in the H-beam for the fastening bolts to pass therethrough with this clamping arrangement.

Figure 14:
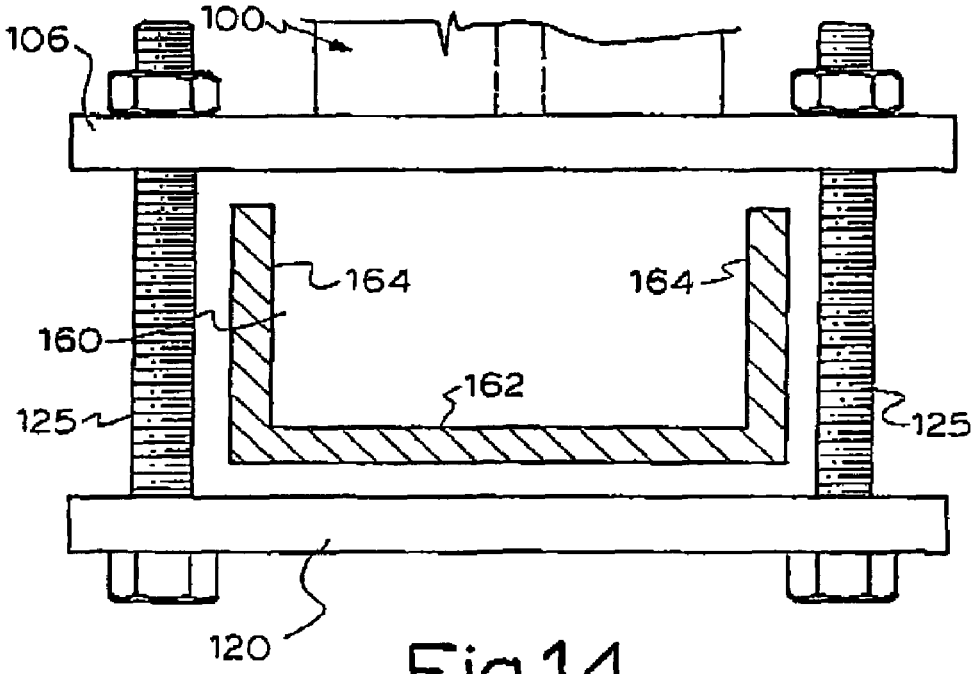
FIG. 14 is an end view of the support post of FIG. 10 mounted on a structure member that is an upwardly opening channel.

FIG. 14 shows a post clamped to an upwardly opening channel 160. The channel 160 has a horizontally extending bottom wall portion 162 and upwardly extending side wall portions 164 on each side of the bottom wall portion 162. The secondary plate 120 is the same as that used for the H-beam attachment described above with reference to FIG. 13.

As before, the secondary plate 120 is positioned directly beneath the base plate 106. However, because of the height of the channel, it is spaced a considerable distance away from the base plate 106. Consequently the fastening elements 125 are considerably longer than those used in FIG. 13 to cover the greater spacing between the two plates 106, 120. The fastening bolts 125 are passed between the plates 106, 120 laterally outwardly of the side wall portions 164 of the U-channel 160 so it is not necessary to drill through the U-channel.

Figure 15:
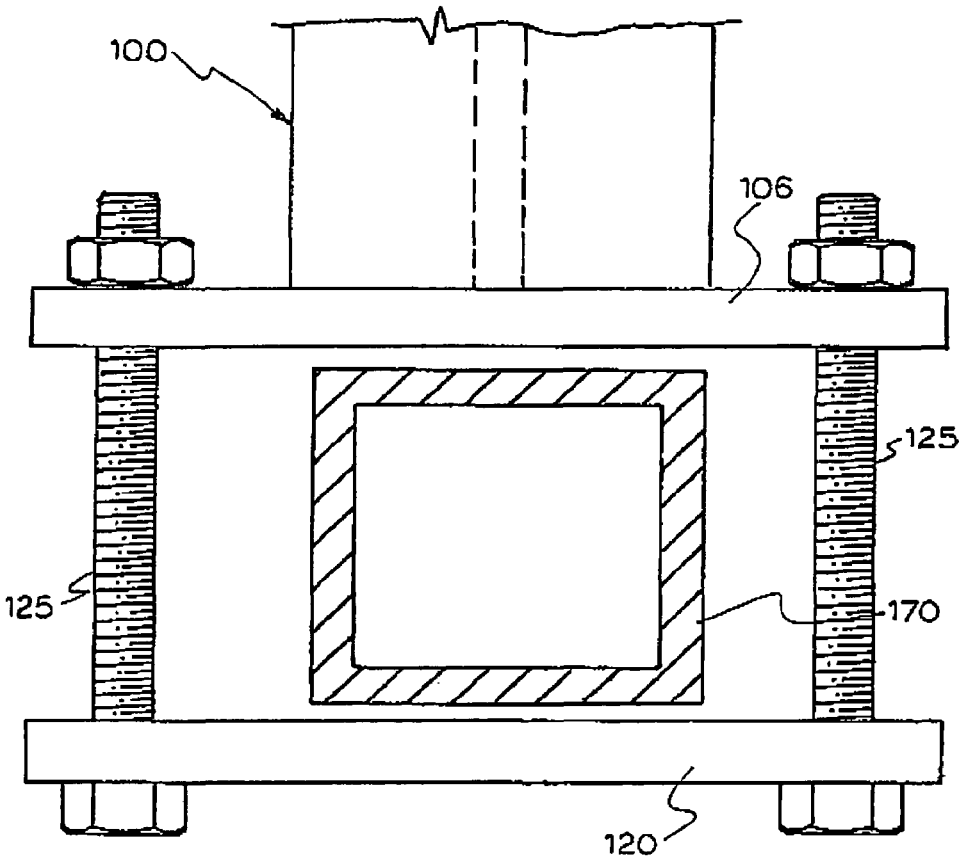
FIG. 15 is an end view of the support post of FIG. 10 mounted on a structure member that is an RHS beam.

FIG. 15 shows a post clamped to a RHS-beam 170. The RHS-beam 170 is in the form of a rectangular tube that is hollow and extends in a horizontally extending direction. The post 100 is mounted on such a beam 170 in a manner very similar to that described above with reference to FIG. 14.

Figure 16:
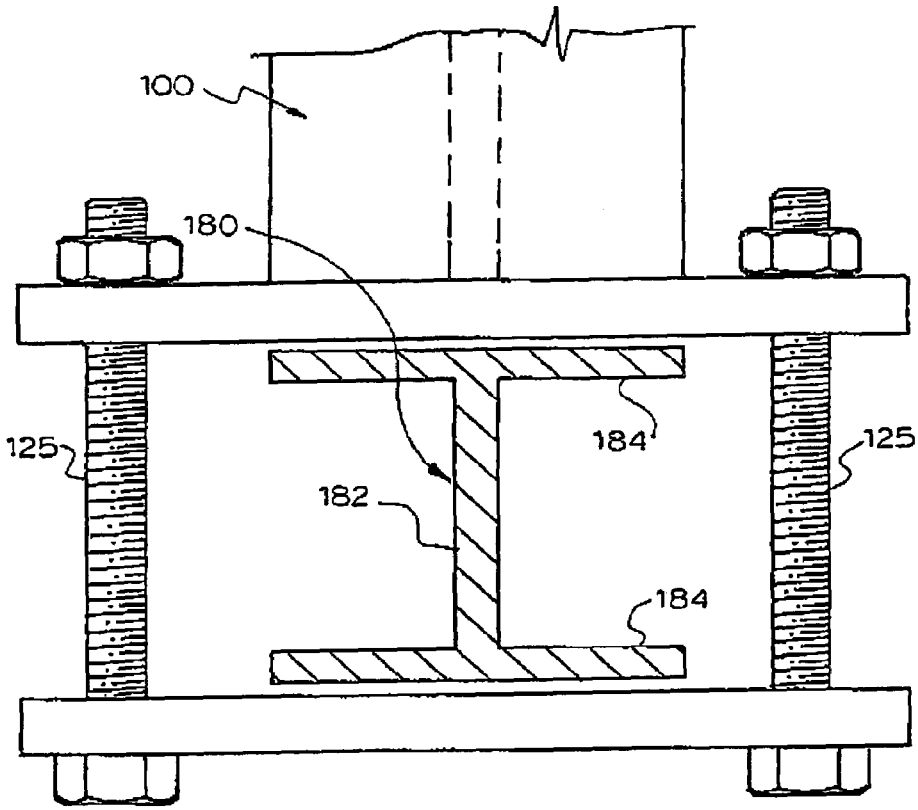
FIG. 16 is an end view of the support post of FIG. 10 mounted on a structure member that is a UB beam.

FIG. 16 illustrates a support post mounted on a UB-beam 180. The UB-beam 180 is broadly like an I-beam with the difference that the web 182 is shorter than that for an I-beam. The beam has flanges 184 on each side of the UB-beam 180 having a similar width to the web 182. Again a support post 100 is clamped to the UB-beam in a similar manner to that shown in FIGS. 14 and 15.

Figure 17:
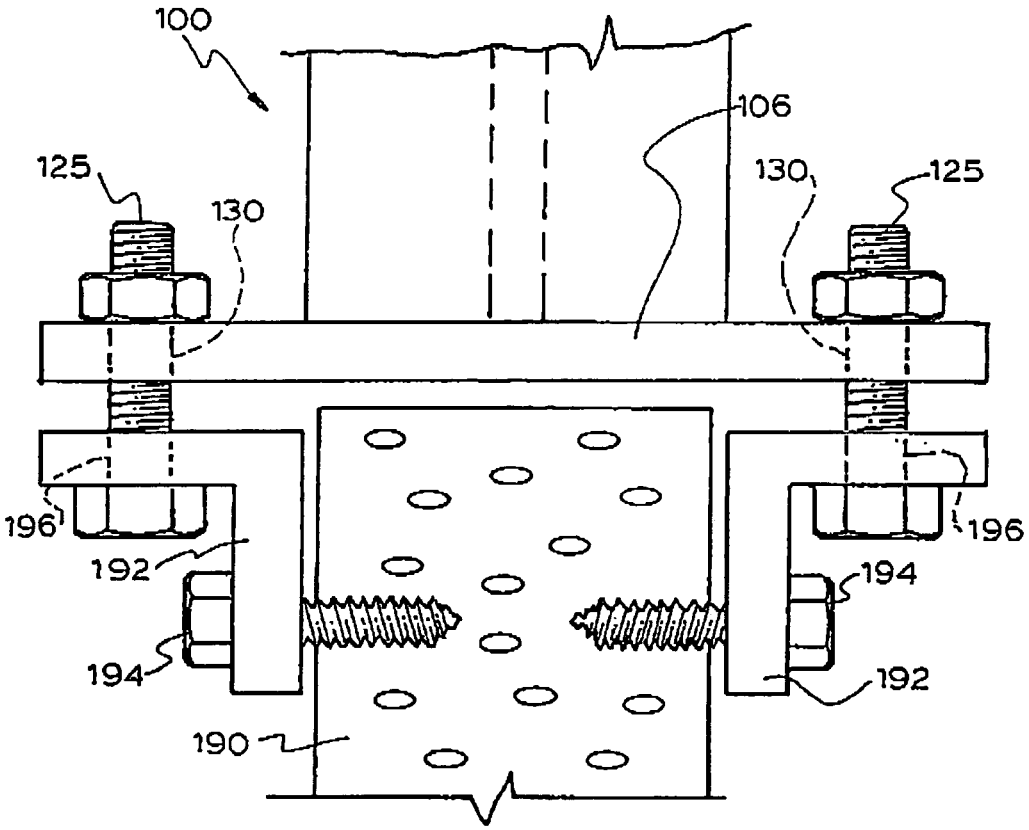
FIG. 17 is an end view of the support post of FIG. 10 mounted on a structure member that is a precast structure in the form of a concrete tilt panel.

FIG. 17 illustrates a support post 100 mounted on a precast concrete structure 190. The secondary plate in this embodiment comprises a right angle bracket 192 on each side of the precast structure 190. The brackets 192 are attached to the precast structure by means of fastening elements, e.g. dynabolts 194, that penetrate into the concrete structure. The right angle brackets 192 are then fastened to the brackets 192 by fastening elements 125 passed through vertically aligned apertures 130, 196 on each of the base plate 106 and right angle brackets 192. This clamps the post 100 to a precast concrete member 190 such as a concrete tilt panel.

Figure 10:
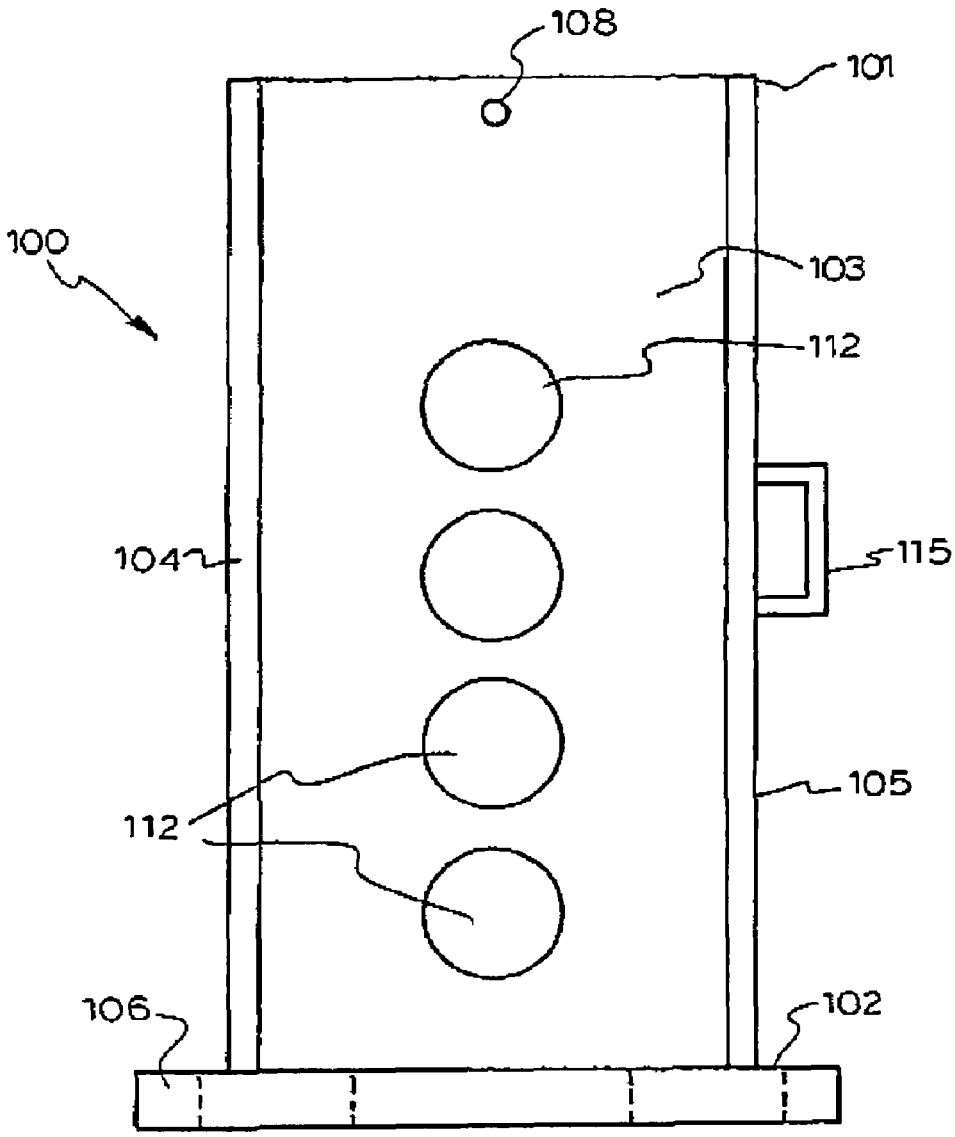
FIG. 10 is a front view of a support post in accordance with another embodiment of the invention.
Figure 11:
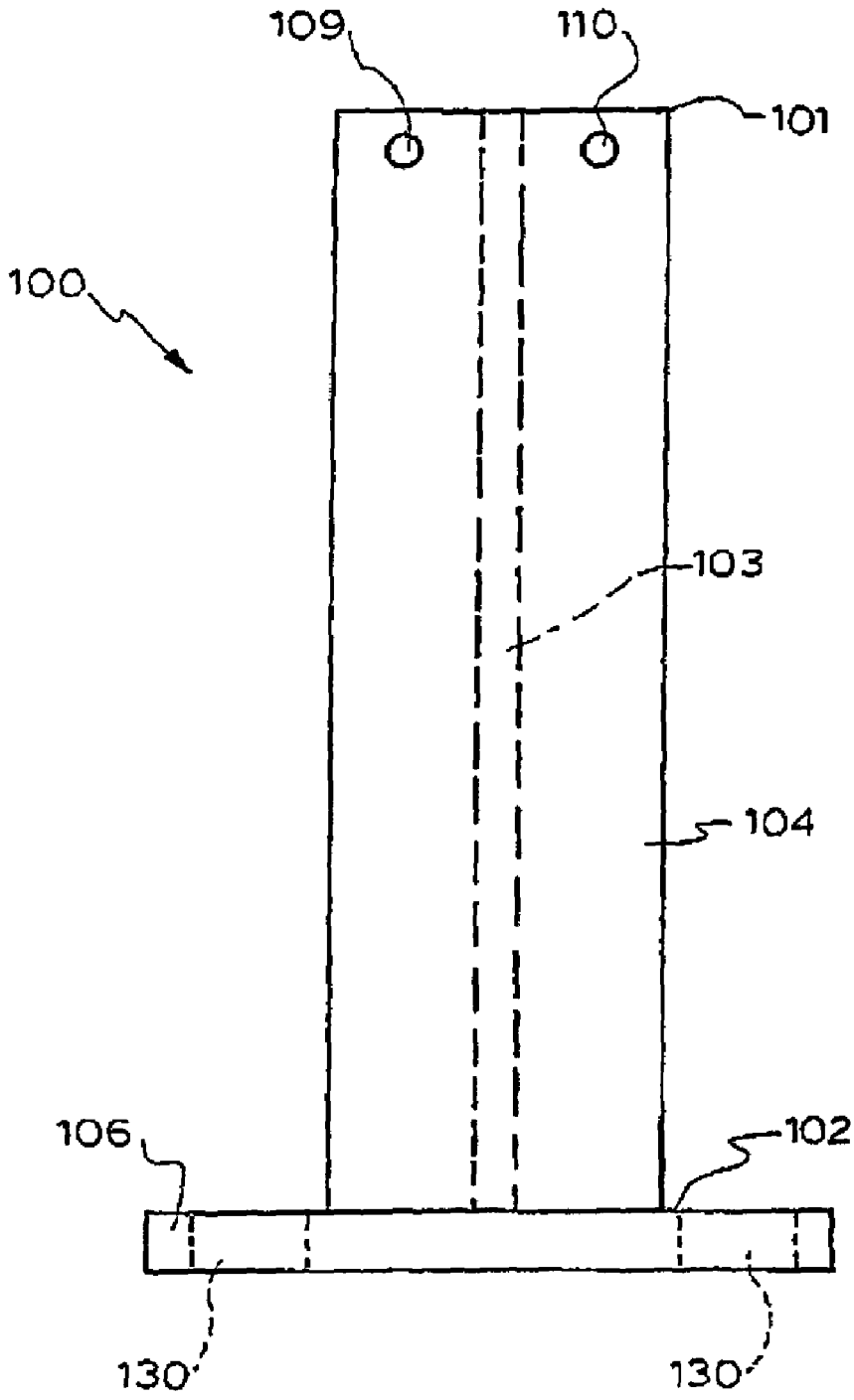
FIG. 11 is a side view of the support post shown in FIG. 10.
Figure 12:
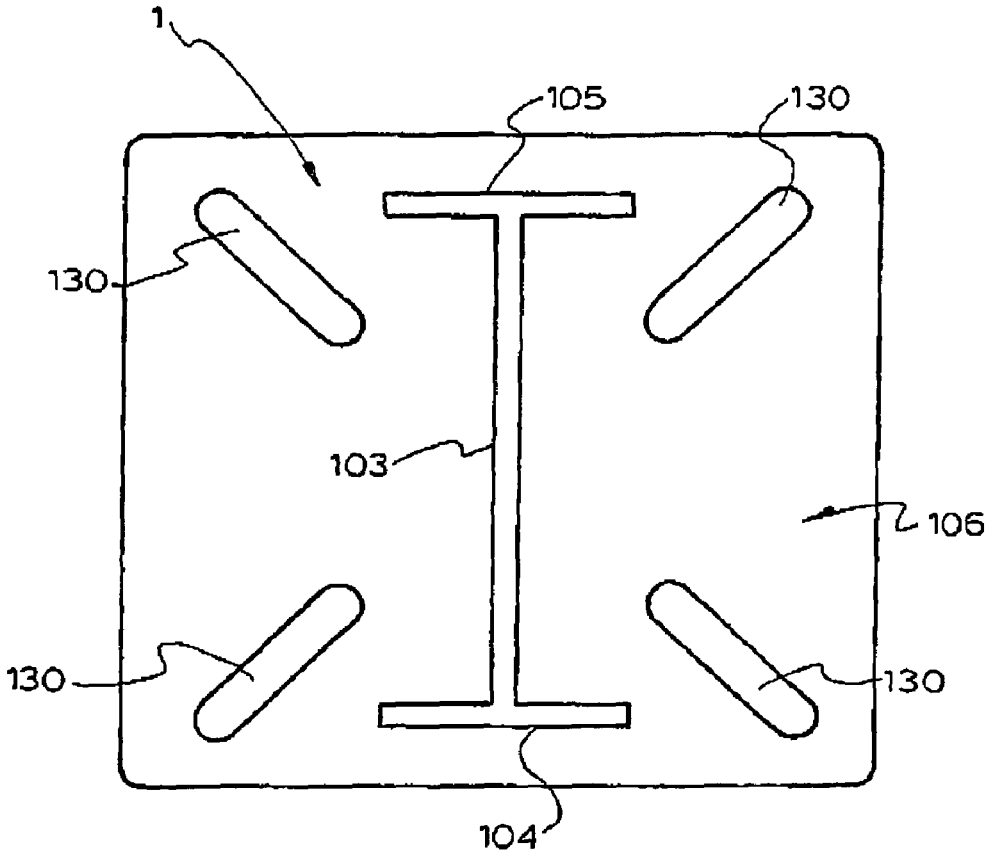
FIG. 12 is a top plan view showing the base plate of the support post of FIG. 10.
Figure 18:
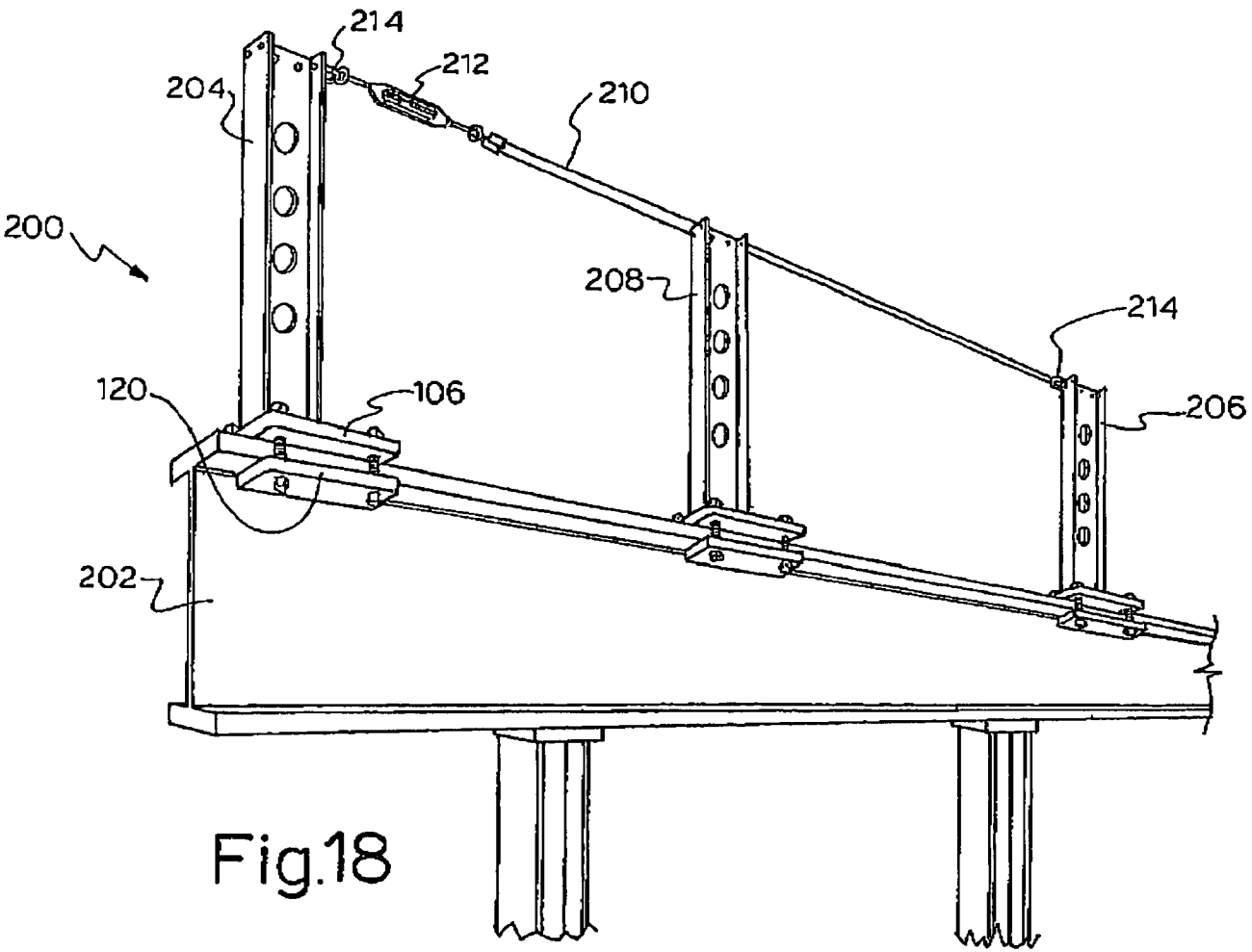
FIG. 18 is a schematic front of a safety apparatus in accordance with the invention utilising the support post shown in FIG. 10.

FIG. 18 shows the safety apparatus with the post shown in FIGS. 10 to 12 in use mounted on a building structure 200. The posts are clamped to an I-beam 202 in the manner illustrated in FIG. 8.

The I-beam 202 is elevated above the ground and forms part of a basic frame of the building. In the illustrated embodiment there are two end posts 204, 206 and an intermediate post 208 extending along the length of the beam 202. The safety line 210 extends between the posts and is tensioned by a tensioning device indicated by reference numeral 212. The line 210 can be connected to the aperture connecting formations 108 in two possible ways. Firstly an anchor bracket, or U-bolt, 214 can be passed through the aperture connecting formation 108 and the line in turn can be attached to the anchor bracket 214. This is particularly advantageous because the shape of the U-bolt acts to centralise the safety line relative to the post. This is beneficial because it loads the support post on its centre line along the line of the web which is its naturally strongest configuration. An off centre force would tend to twist and buckle the support post.

Alternatively the line can be passed through the aperture and/or attached to the support post by being passed through at least one said aperture in the post.

The apparatus shown in FIG. 18 shows the safety line connected to the end posts by means of a turnbuckle and passing through the apertures of the intermediate post 208. Another option (not shown) is for the intermediate post 208 to have U-bolts at each end thereof. Then the safety line from post 204 is passed through the nearest U-bolts of post 208. Similarly the safety line from post 206 is passed through the other U-bolts on post 208. This way the safety line is comprised of sections of line extending between adjacent posts, and each end of each section is connected to the post by means of a U-bolt. That way the force applied by the safety line to the post 208 is also centralised.

Figure 19:
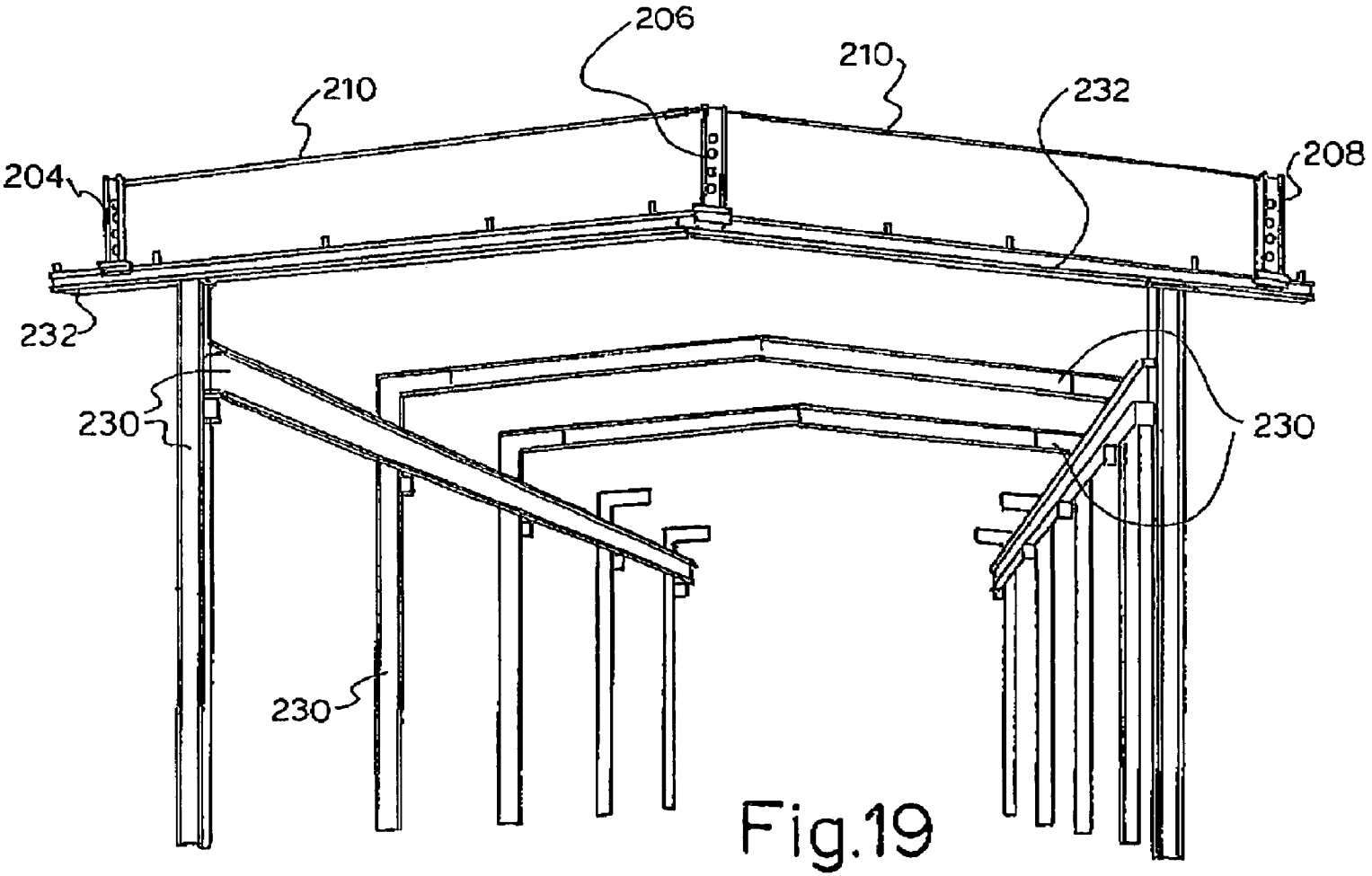
FIG. 19 is a schematic three dimensional view of a multi storey structure utilising the safety apparatus thereon shown in FIG. 18.

FIG. 19 shows the safety apparatus in use on a multi storey building. The underlying structure of the building is formed by a series of steel beams 230. Two such beams 232 form a rafter like structure at the top of the building and the safety apparatus is mounted on these rafters.

There are three support posts 204, 206, 208 mounted on the rafters 232. One post is at each end and another is positioned on the midline and highest point of the roof. Workers are required to work on the rafters to put the roof purlins and roof sheeting in place. These workers can clip their harness leads onto the safety line 210 when they get onto the building and then move about on the roof and do their work. For example the safety line 210 shown in the drawings permit a worker to move freely from one side of the building to the other along the roof members to which the posts are mounted. In the event that the worker falls, the safety apparatus arrests their fall and they do not crash to the ground four storeys below. Typically they only fall about 0.5 m before their fall is arrested by the safety line and they can then recover and pull themselves back up onto the beams.

It will be readily recognised by skilled addressees that safety lines could also be established at ninety degrees to the shown lines by passing the lines between aligned posts on adjacent but parallel beams. This way a network of lines extending at ninety degrees to each other can be built up on the beams.

Figure 20:
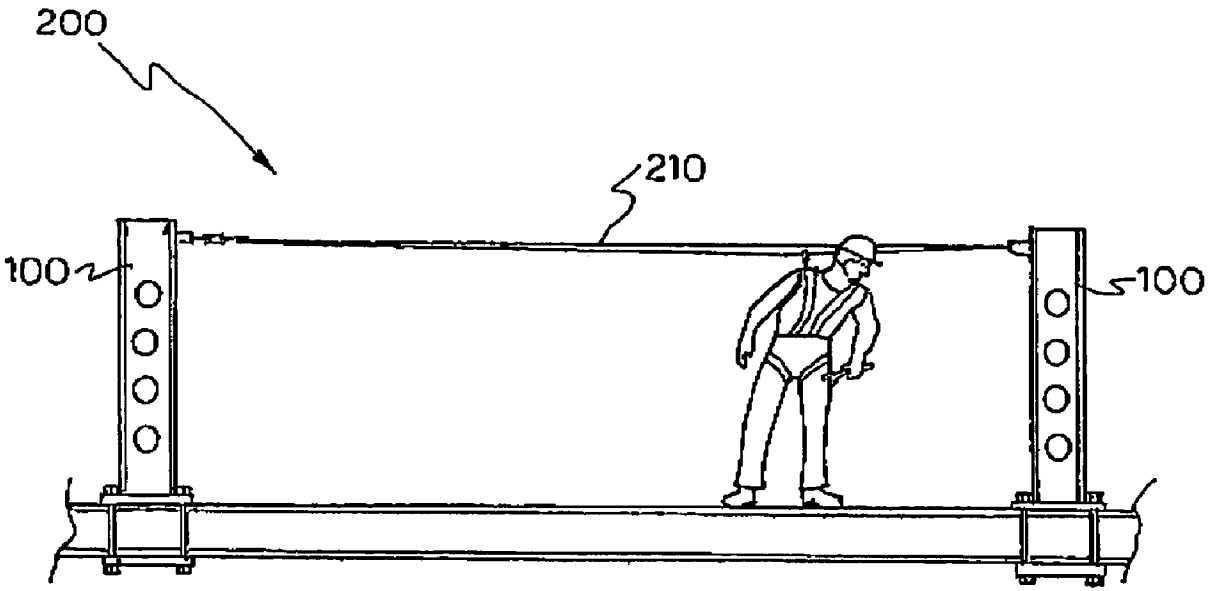
FIG. 20 is a schematic drawing of the apparatus of the invention showing the approximate deflection of the safety line when a worker falls.

FIG. 20 also shows schematically the likely deflection of the safety line when a worker falls off the structure and the fall is arrested by the safety apparatus. A feature that should be noted is that the safety line typically only deflects by about 0.5 m. This can generate a maximum shock loading in the line of 400–500 kg. The vertical positioning of the line at just above head height in combination with the design of the post and the clamp for clamping the post to the structure member all contribute to providing a highly effective fall arrest apparatus.

Figure 21:
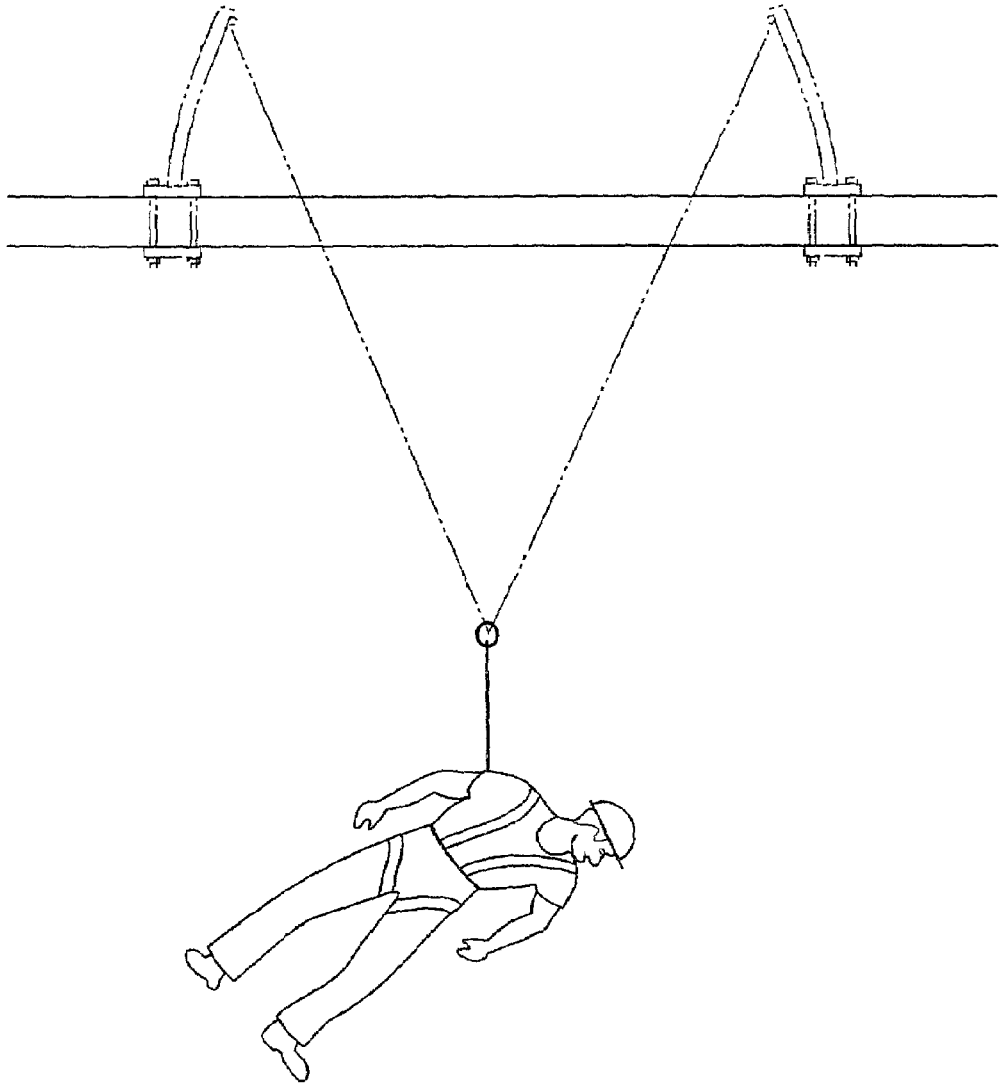
FIG. 21 is a schematic drawing of a hypothetical prior art apparatus showing the approximate deflection of the safety line when a worker falls.

FIG. 21 shows the deflection of the safety line on a prior art safety apparatus. The safety line is positioned lower than that shown in the Applicant's apparatus and also the line deflection of this apparatus will be substantially greater if a worker falls. As a result the loadings on the line and posts to arrest the fall of a worker when the line and lead are fully extended would be substantially greater. For example a deflection of 8 metres can lead to a shock impact load of up to 8 tons which is huge.

One advantage of the apparatus described above particularly with reference to FIGS. 10 to 19 is that it has the capability to effect fall arrest of a worker. It does not simply provide lateral restraint or a peripheral safety rail arrangement. A further advantage is that the posts are sufficiently high for the safety line to pass above the head of the average sized worker. As a result a worker can move freely around beneath the safety line and perform their work.

A further advantage of the apparatus is that the clamping of the support posts to the structure members is extremely efficacious. This can be attributed to the features of the clamp, including the fact that a positive clamping action is exerted on each side of the post. This is referred to by the Applicant as a double attachment point and can support up to four workers off one end post.

This capability is vastly superior to any other commercially available safety apparatuses of which the Applicant is aware.

A further advantage is the fact that the I shaped support post can be formed in a single extrusion operation and does not have to have to fabricated by welding different components together. This enables the product as a whole to be produced at a price competitive with other products yet have vastly superior performance properties. This lower cost is important as there are constant pressures in the building industry to keep construction costs down and particularly the costs of providing safety equipment.

Another significant advantage of the product is that the posts are adapted to be clamped to a wide variety of structure members and many of the common members likely to be used on building structures. This includes the usual beams as well as concrete tilt panels which are particularly widely used in building construction these days.

A yet further advantage is that the posts which are made of aluminium are relatively lightweight. The post illustrated in FIG. 10 weighs about 27 kg. The posts are thus capable of being lifted up if necessary and being carried and moved around on a structure if necessary. Further the posts have a handle to assist the handling and lifting of them. Further the posts are robust and are unlikely to be damaged if they are accidentally dropped. Yet further they are rust resistant and will not easily rust.

In conclusion, the applicant believes that this invention provides an apparatus for enhancing worker safety which has significant advantages over presently available safety configurations.

It will of course be realised that the above has been given only by way of illustrative example of the invention and that all such modifications and variations thereto as would be apparent to persons skilled in the art are deemed to fall within the broad scope and ambit of the invention as is herein set forth.

What is claimed is:

1. A safety apparatus for use by a worker on an elevated structure for arresting the fall of the worker should they fall, the apparatus comprising:

at least two support posts having an upper end and a lower end supported on the structure and the posts being spaced apart from each other on the structure, each support post having a central web having a first end and a second end and a flange at each end of the web extending transverse to the web, wherein the web and transverse flanges extend from the lower end to the upper end of the post;

a clamp on the lower end of each support post for clamping the post to the structure;

at least one connecting formations towards the upper end of each post for connecting a safety line thereto or passing a safety line therethrough; and an overhead safety line extending between said posts.

2. A safety apparatus according to claim 1, wherein each support post has a cross-sectional configuration in the form of an I, and wherein the apparatus further includes a harness and lead for each worker which can be operatively connected to the safety line.

3. A safety apparatus according to claim 2, wherein the lead includes a slide coupling for permitting the lead to slide freely along the length of the safety line, and wherein the slide coupling can be opened on demand to connect and disconnect the worker from the safety line.

4. A safety apparatus according to claim 3, wherein the coupling is in the form of a quick release shackle.

5. A safety apparatus according to claim 1, wherein each support post is oriented relative to the safety line with the web extending substantially parallel to the safety line and with the flanges extending transversely to the safety line, and wherein the web and flanges of each post have a constant cross-section from the lower end to the upper end.

6. A safety apparatus according to claim 1, wherein each clamp comprises a base plate fast wit the support post, a secondary plate or clamping plate spaced beneath the base plate, and fastening elements for drawing the two plates towards each other with a member of the structure firmly clamped therebetween.

7. A safety apparatus according to claim 6, wherein the base plate projects laterally outwardly from the post on at least two opposed sides thereof, and the base plate defines at least one slot aperture on each said opposed side.

8. A safety apparatus according to claim 6, wherein each fastening element comprises a screw threaded bolt passed through a said slot aperture in the base plate and a bolt aperture in the clamping plate, and a nut passed over the bolt that is fastened to clamp the base plate, structure member and clamping plate together.

9. A safety apparatus according to claim 8, wherein each clamp further includes a spacing formation sandwiched between the base plate and the clamping plate and positioned relative to the bolts so as to exert a pivotable clamping action on the clamping plate and enhance the clamping of to clamping plate to the structure member.

10. A safety apparatus according to claim 1, wherein at least one said connecting formation comprises an aperture defined in the web of the support post or an aperture defined in each of the flanges of the support post.

11. A safety apparatus according to claim 1, wherein at least one said connecting formation comprises a U-bolt projecting out from to said flange of the support, wherein the U-bolt is mounted in a bilaterally symmetrical position on the flange so as to centralise the forces applied through the safety line to the post and thereby load the post along the line of the central web.

12. A safety apparatus according to claim 1, further including at least one cut-out defined in the web of each post intermediate the upper and lower ends thereof for reducing the weight of the post.

13. A safety apparatus according to claim 1, further including a handle formation on at least one support post for assisting a worker to lift and carry the support post, and wherein the support posts are made of aluminium.

14. A safety apparatus for use by a worker on an elevated structure for resting the fall of the worker should they fall, the apparatus comprising:

at least two support posts having an upper end and a lower end supported on the structure and the posts being spaced apart from each other on the structure, each support post having a central web having a first end and a second end and a flange at each end of the web extending transverse to the web;

a clamp on the lower end of each support cost for clamping the cost to the structure, wherein each clamp comprises a base plate fast with the support post, a secondary plate or clamping plate spaced beneath the base plate, and fastening elements for drawing the two plates towards each other with a member of the structure firmly clamped therebetween;

at least one connecting formations towards the upper end of each post for connecting a safety line thereto or passing a safety line therethrough; and an overhead safety line extending between said posts.

15. A safety apparatus according to claim 14, wherein the base plate projects laterally outwardly from the post on at least two opposed sides thereof, and the base plate defines at least one slot aperture on each said opposed side.

16. A safety apparatus according to claim 15, wherein the base plate defines two diagonally extending slot apertures on each said opposed side.

17. A safety apparatus according to claim 15, wherein each fastening element comprises a screw threaded bolt passed through a said slot aperture in the base plate and a bolt aperture in the clamping plate, and a nut passed over the bolt that is fastened to clamp the base plate, stricture member and damping plate together.

18. A safety apparatus according to claim 14, wherein each clamp further includes a spacing formation sandwiched between the base plate and the clamping plate and positioned relative to the bolts so as to exert a pivotable clamping action on to clamping plate and enhance the clamping of the clamping plate to the structure member.

19. A safety apparatus according to claim 14, wherein the clamping plate or secondary plate is substantially vertically aligned with the base plate but spaced beneath the base plate with the member sandwiched therebetween, and a said fastening element extends through the base plate and secondary plate laterally outwardly of the structure member on each side of the member to encase the member within the base plate, secondary plate and fastening elements.

20. A safety apparatus according to claim 19, wherein two said fastening elements are passed through the base plate and secondary plate laterally outwardly of each side of the structure member.

21. A safety apparatus according to claim 19, wherein the structure member is one of an I-beam, H-beam, channel beam, PBS-beam or UB-beam.

22. A safety apparatus according to claim 14, wherein at least one connecting formation comprises an aperture defined in the web of the support post or an aperture defined in each of the flanges of the support post.

23. A safety apparatus according to claim 14, wherein said at least one connecting formation comprises a U-bolt projecting out from the flange of the post, wherein the U-bolt is mounted in a bilaterally symmetrical position on the flange so as to centralise the forces applied through the safety line to the post and thereby load the past along the line of the central web.

24. A safety apparatus according to claim 23, wherein the U-bolt is mounted on the post by being passed through apertures defined in a said usage of the post.

25. A safety apparatus according to claim 14, further including at least one cut-out defined in the web of each post intermediate the upper and lower ends thereof for reducing the weight of the post.

26. A safety apparatus according to claim 14, further including a handle formation on at least one support post for assisting a worker to lift and carry to support post, and wherein the support posts are made of aluminium.

27. A safety apparatus according to claim 14, further including a tensioner operatively mounted on the safety line extending between the support posts such that operation of the tensioner acts directly to increase or decrease tension in the safety line.

28. A safety apparatus according to claim 14, wherein the safety line is at a height of 1.5–2.5 m above the member on which the posts are mounted.

29. A safety apparatus according to claim 28, wherein the safety line is at a said height of 1.7–2.0 m.

30. A safety apparatus according to claim 14, wherein the safety line is approximately 1.8 m above said member and the support posts are a similar height.

31. A safety apparatus according to claim 14, wherein each support post is approximately 1.8 m high.

32. A safety apparatus for use by a worker on an elevated structure for arresting the fall of the worker should they fall, the apparatus comprising;

at least two support posts having an upper end and a lower end supported on the structure and spaced apart from each other on the structure, each support post having a central web and transverse flanges projecting outwardly from both sides of the web at each end of the web;

a clamp on the lower end of each support post for clamping the post to the structure, the clamp comprising in turn abase plate fast with the support post, a secondary plate or clamping plate spaced beneath the base plate, and fastening elements for drawing the two plates towards each other with a member of the structure firmly clamped there between, and wherein the base plate projects laterally outwardly from the post on at least two opposed sides thereof and the base plate defines at least one slot aperture on each said opposed side;

connecting formations towards the upper end of each post for connecting a safety line thereto or passing a safety line there through;

an overhead safety line extending between said posts at a height of 1.7 to 2.0 metres above the member on which the posts are mounted; and a harness and lead for at least one worker which can be operatively connected to the safety line.

33. A safety apparatus for use by a worker on an elevated structure for arresting to fall of the worker should toy fall, the apparatus comprising:

at least two support posts having an upper end and a lower end supported on the structure and spaced apart from each other on the structure;

a clamp on the lower end of each support post for clamping the post to the structure, wherein each clamp comprises a base plate fast with the support post, a secondary plate or clamping plate spaced beneath the base plate, and fastening elements for drawing the two plates towards each other with a member of the structure firmly clamped therebetween;

at least one connecting formations towards the upper end of each post for connecting a safety line thereto or passing a safety line therethrough; and an overhead safety line extending between said posts, the safety line being at a height of 1.5–2.5 m above the member on which the posts are mounted.

34. A safety apparatus for use by a worker on an elevated structure for arresting the fall of the worker should they fall, the apparatus comprising:

at least two support posts having an upper end and a lower end supported on the structure and the posts being spaced apart from each other on the structure, each support post having a cross-sectional configuration in the form of an I;

a clamp on the lower end of each support post for clamping the post to the structure;

at least one connecting formation towards the upper end of each post for connecting a safety line thereto or passing a safety line there through; and an overhead safety line extending between said posts.

35. A safety apparatus for use by a worker on an elevated structure for arresting the fall of the worker should they fall, the apparatus comprising:

at least two support posts having an upper end and a lower end supported on the structure and the posts being spaced apart from each other on the structure;

a clamp on the lower end of each support post for clamping the post to the structure, wherein each clamp comprises a base plate fast with the support post, a secondary plate or clamping plate spaced beneath the base plate, and fastening elements for drawing the two plates towards each other with a member of the structure firmly clamped therebetween;

at least one connecting formation towards the upper end of each post for connecting a safety line thereto or passing a safety line therethrough; and an overhead safety line extending between said posts.

* * * * *